US008678228B2

(12) United States Patent
Steininger

(10) Patent No.: US 8,678,228 B2
(45) Date of Patent: Mar. 25, 2014

(54) LIQUID METERING ASSEMBLY

(75) Inventor: Jeff Steininger, St. Mary's, OH (US)

(73) Assignee: Zak Designs, Inc., Spokane, WA (US)

( * ) Notice: Subject to any disclaimer, the term of this patent is extended or adjusted under 35 U.S.C. 154(b) by 27 days.

(21) Appl. No.: 13/536,587

(22) Filed: Jun. 28, 2012

(65) Prior Publication Data

US 2014/0001192 A1 Jan. 2, 2014

(51) Int. Cl.
*A47G 19/22* (2006.01)
*A61J 7/00* (2006.01)

(52) U.S. Cl.
USPC ..... 220/703; 220/719; 220/714; 220/711; 220/717; 220/203.18; 220/203.19; 220/253; 215/11.1; 215/11.4; 215/11.5

(58) Field of Classification Search
CPC ..... A61J 9/04; A61J 11/02; A47G 19/22; A47J 19/2266
USPC ..... 220/719, 714, 717, 203.18, 256.1, 253; 215/11.4, 11.5
See application file for complete search history.

(56) References Cited

U.S. PATENT DOCUMENTS 2,372,281 A * 3/1945 Jordan ..... 215/11.5
2,608,841 A * 9/1952 Rice ..... 215/309
2,630,118 A * 3/1953 Casey ..... 215/11.4
2,745,568 A * 5/1956 Newton ..... 215/11.4
2,803,251 A * 8/1957 White ..... 215/11.4
2,811,270 A * 10/1957 Kurkjian ..... 215/11.5
3,211,315 A * 10/1965 Griesinger ..... 215/11.1
3,335,890 A * 8/1967 Grundmann et al. ..... 215/11.1
3,360,160 A * 12/1967 Spencer ..... 220/719
3,727,808 A * 4/1973 Fitzgerald ..... 222/482
4,130,215 A * 12/1978 Corey et al. ..... 220/719
4,146,157 A * 3/1979 Dixon et al. ..... 222/424
4,600,111 A * 7/1986 Brown ..... 215/6
5,101,992 A * 4/1992 Serre ..... 215/11.5
5,143,248 A * 9/1992 Sawatsky ..... 220/711
5,150,800 A * 9/1992 Sarter et al. ..... 215/11.4
5,249,703 A * 10/1993 Karp ..... 220/719
5,348,179 A * 9/1994 Walker ..... 220/203.18
5,542,670 A * 8/1996 Morano ..... 220/714
5,706,973 A * 1/1998 Robbins et al. ..... 220/714
5,791,503 A * 8/1998 Lyons ..... 215/11.5
5,890,620 A * 4/1999 Belcastro ..... 220/714
5,890,621 A * 4/1999 Bachman et al. ..... 220/717
5,938,053 A * 8/1999 Verbovszky et al. ..... 215/6
6,102,245 A * 8/2000 Haberman ..... 220/714
6,112,919 A * 9/2000 Ho ..... 215/11.4
6,138,710 A * 10/2000 Chomik et al. ..... 137/512.15
6,230,923 B1 * 5/2001 Hung ..... 220/703
6,305,570 B1 * 10/2001 Atkin et al. ..... 220/714
6,401,949 B1 * 6/2002 Lyle et al. ..... 215/11.4

(Continued)

*Primary Examiner* — Mickey Yu
*Assistant Examiner* — Gideon Weinerth
(74) *Attorney, Agent, or Firm* — Paine Hamblen, LLP

(57) ABSTRACT

A liquid metering assembly is described and which includes a container for enclosing a source of a liquid to be dispensed; a container cap defining a dispensing aperture and a vent aperture which is releasably affixed to the container; a moveable diaphragm releasably cooperating with the container cap, and coupled in fluid flowing relation relative to the dispensing aperture, and wherein the moveable diaphragm has a valve member; and a moveable liquid volume control member which cooperates with the moveable diaphragm, and wherein, when a predetermined suction is applied to the dispensing aperture of the container cap, a user may withdraw a given volume of liquid from the beverage container.

20 Claims, 11 Drawing Sheets

(56) References Cited

U.S. PATENT DOCUMENTS

| | | | | |
|---|---|---|---|---|
| 6,508,379 | B1 * | 1/2003 | Van De Pol-Klein Nagelvoort et al. | 220/714 |
| 6,568,557 | B2 * | 5/2003 | Fusco et al. | 220/714 |
| 6,705,485 | B1 * | 3/2004 | Sato et al. | 220/713 |
| 6,732,882 | B2 * | 5/2004 | Belcastro | 220/714 |
| 6,758,364 | B1 * | 7/2004 | Rohrig | 220/714 |
| 6,786,352 | B2 * | 9/2004 | Belcastro | 220/714 |
| 6,883,672 | B2 * | 4/2005 | Dunn et al. | 215/11.5 |
| 7,150,369 | B1 * | 12/2006 | Fryar | 215/11.4 |
| 7,150,370 | B2 * | 12/2006 | Pyun | 215/11.5 |
| 7,198,167 | B2 * | 4/2007 | Marsden et al. | 220/254.4 |
| 7,419,069 | B2 * | 9/2008 | Naesje | 220/714 |
| 7,478,733 | B2 * | 1/2009 | Hsu | 215/11.1 |
| 7,556,172 | B2 * | 7/2009 | Lane | 220/714 |
| 7,575,126 | B2 * | 8/2009 | Kemper | 220/714 |
| 8,033,420 | B2 * | 10/2011 | Roseblade et al. | 220/731 |
| 8,256,642 | B2 * | 9/2012 | McNamara et al. | 220/714 |
| 8,333,286 | B2 * | 12/2012 | Spinelli et al. | 215/11.4 |
| 8,333,299 | B2 * | 12/2012 | Kemper et al. | 220/719 |
| 8,453,870 | B2 * | 6/2013 | Berg | 220/703 |
| 8,505,767 | B2 * | 8/2013 | Giraud et al. | 220/714 |
| 2001/0017306 | A1 * | 8/2001 | Wan et al. | 222/522 |
| 2001/0027956 | A1 * | 10/2001 | Bonacorso et al. | 215/11.1 |
| 2001/0035420 | A1 * | 11/2001 | Fusco et al. | 220/714 |
| 2002/0185495 | A1 * | 12/2002 | Manganiello | 220/714 |
| 2003/0209555 | A1 * | 11/2003 | Belcastro | 220/714 |
| 2004/0173623 | A1 * | 9/2004 | Yuen | 220/714 |
| 2005/0045647 | A1 * | 3/2005 | Hession et al. | 220/714 |
| 2005/0072787 | A1 * | 4/2005 | Morris et al. | 220/712 |
| 2005/0072788 | A1 * | 4/2005 | Lieberman et al. | 220/714 |
| 2005/0205589 | A1 * | 9/2005 | Davis et al. | 220/714 |
| 2005/0224495 | A1 * | 10/2005 | Kartinian | 220/253 |
| 2006/0037963 | A1 * | 2/2006 | Pillado | 220/714 |
| 2006/0151499 | A1 * | 7/2006 | Lieberman et al. | 220/203.11 |
| 2006/0169694 | A1 * | 8/2006 | Kemper | 220/303 |
| 2006/0237387 | A1 * | 10/2006 | Pyun | 215/11.5 |
| 2006/0249521 | A1 * | 11/2006 | Dark | 220/780 |
| 2006/0261064 | A1 * | 11/2006 | Holley, Jr. | 220/203.06 |
| 2007/0012698 | A1 * | 1/2007 | Durdon et al. | 220/253 |
| 2007/0051727 | A1 * | 3/2007 | Holley, Jr. | 220/367.1 |
| 2008/0078200 | A1 * | 4/2008 | Roth et al. | 62/457.4 |
| 2008/0128438 | A1 * | 6/2008 | Lane | 220/717 |
| 2008/0142519 | A1 * | 6/2008 | Chou | 220/253 |
| 2009/0020544 | A1 * | 1/2009 | Yuen | 220/714 |
| 2009/0039047 | A1 * | 2/2009 | Shtalryd | 215/11.5 |
| 2010/0044386 | A1 * | 2/2010 | Samson | 220/719 |
| 2010/0147862 | A1 * | 6/2010 | Keefe et al. | 220/714 |
| 2010/0270322 | A1 * | 10/2010 | Lieberman et al. | 220/714 |
| 2011/0198349 | A1 * | 8/2011 | Lane | 220/203.04 |
| 2012/0000929 | A1 * | 1/2012 | Ulstad et al. | 222/1 |
| 2012/0187124 | A1 * | 7/2012 | Chang | 220/253 |
| 2012/0261375 | A1 * | 10/2012 | Loging | 215/11.4 |
| 2013/0119008 | A1 * | 5/2013 | Pfenniger et al. | 215/11.5 |
| 2013/0213966 | A1 * | 8/2013 | Steininger et al. | 220/253 |
| 2013/0233870 | A1 * | 9/2013 | Miller | 220/719 |

* cited by examiner

LIQUID METERING ASSEMBLY

TECHNICAL FIELD

The present invention relates to a liquid metering assembly, and more specifically to a liquid metering assembly which finds usefulness when incorporated into the structure of a removable lid that is employed with a beverage container, and wherein the liquid metering assembly substantially prevents the removal or withdrawal of liquid from the beverage container when the beverage container is not in use, or is accidentally overturned.

BACKGROUND OF THE INVENTION

Various removable lids for sealing liquid storage and other beverage containers are well known. In particular, variously designed lids having drinking apertures which allows for the selective removal of a beverage contained within the beverage container have been utilized throughout recorded history. With regards to drinking vessels which may be utilized by infants, young children, and the like, much effort has been directed towards the development of beverage container lids which allows the infant, or young child to sip or otherwise withdraw liquid from the container in a given measured amount and further substantially prohibits the spilling of the liquid from the container in the event that the child, for example, inadvertently overturns the drinking vessel during their daily activities. The prior art is replete with numerous examples of various arrangements utilized to prevent fluid leakage from the caps which are releasably affixed to a beverage container. Perhaps the most germane art which is currently available and which is directed to solving the problem concerning the development of a spill-proof beverage container is found in U.S. Publication No. 2010/0044386A1 to Samson. This reference discloses a cap or closure member for a spill proof beverage container and which includes a demand valve which is incorporated into the cap and which, when rendered operational, allows for the selective dispensing of a liquid from the beverage container when an infant or small child applies a suction force to the described drinking spout. In this arrangement, when suction is not being applied to the drinking spout, the demand valve substantially prohibits the release of fluid from the beverage container so as to prevent spills if the container is accidentally overturned.

While the aforementioned, and other devices in the art have worked with varying degrees of success, shortcomings in their individual designs have detracted from their usefulness. For example, in training small children to feed themselves, parents have often found it useful to utilize various assemblies which can be readily adjusted so as to meter selective amounts of fluid to the child so that choking and spilling of the fluid is substantially avoided. While some devices have been developed to allow a supervising adult to adjust the amount of fluid dispensed through such drinking caps, as a general matter, it is fair to say that these devices have typically been complex in their overall design, often cumbersome to clean, and have not typically and reliably prevented the spilling of liquid in the event that the beverage container is accidently overturned by the infant during their day-to-day activities.

Therefore, a liquid metering assembly which would achieve the benefits of the prior art references while avoiding the detriments which are individually associated therewith is the subject matter of the present invention.

SUMMARY OF THE INVENTION

A first aspect of the present invention relates to a liquid metering assembly which includes, a container enclosing a source of a liquid to be dispensed; a container cap for engaging and enclosing the source of fluid within the container, and wherein the container cap defines a dispensing aperture, and a vent aperture; a moveable diaphragm releasably cooperating with the container cap and coupled in fluid flowing relation relative to the dispensing aperture, and wherein the moveable diaphragm further has a valve member; and a moveable liquid volume control member which sealably, matingly cooperates with the moveable diaphragm, and which further defines a liquid receiving chamber, and a fluid flowing aperture which extends therethrough, and wherein the valve member is received in the fluid flowing aperture, and is moveable relative thereto when a suction is applied to the dispensing aperture of the container cap, and wherein a selective movement of the liquid volume control member relative to the moveable diaphragm varies a volume of the liquid which is dispensed from the container when a given amount of suction is applied to the dispensing aperture.

Still another aspect of the present invention relates to a liquid metering assembly which includes a beverage container having an internal cavity for receiving a source of a liquid to be consumed by a user of the beverage container, and wherein the beverage container has a neck portion which communicates with the internal cavity thereof; a drinking cap which is releasably engagable with the neck portion, and which has a drinking aperture through which the source of liquid may move from the internal cavity and then be consumed by the user, and a vent aperture which couples the surrounding ambient environment with the internal cavity; a moveable diaphragm matingly cooperating with the drinking cap, and further having an elongated valve member which depends downwardly from the diaphragm, and which is further moveable therewith; and an adjustable liquid volume control member defining a liquid receiving chamber, and which is located in releasable mating cooperation with the moveable diaphragm and which is further disposed in fluid flowing relation relative to the drinking aperture, and wherein the liquid volume control member defines a fluid flowing aperture which extends through the liquid volume control member, and which couples the liquid receiving chamber with the internal cavity of the beverage container, and wherein the elongated valve member extends through the fluid flowing aperture, and wherein a suction supplied by a user to the drinking aperture causes the diaphragm to move away from the drinking cap, and thereby urge the elongated valve member from a first, seated, sealed position where the elongated valve member is positioned against the liquid volume control member, and substantially occludes the fluid flowing aperture, and which further prohibits the flow of the source of the liquid from the internal cavity of the beverage container to the drinking aperture, and by way of the fluid flowing aperture; to a second, fluid flowing position, and wherein, in the second position, the elongated valve member is displaced from the first seated position, and which permits the flow of the source of the liquid from the internal cavity of the beverage container and through the fluid flowing aperture and then to the drinking aperture, and by way of the liquid receiving chamber.

These and other aspects of the present invention will be discussed in greater detail hereinafter.

BRIEF DESCRIPTION OF THE DRAWING

Preferred embodiments of the present invention are described, below, with reference to the following accompanying drawings.

DETAILED DESCRIPTION OF THE PREFERRED EMBODIMENTS

This disclosure of the invention is submitted in furtherance of the constitutional purposes of the U.S. Patent laws "to promote the progress of science and useful arts." (Article I, Section 8).

First Form

Figure 1:
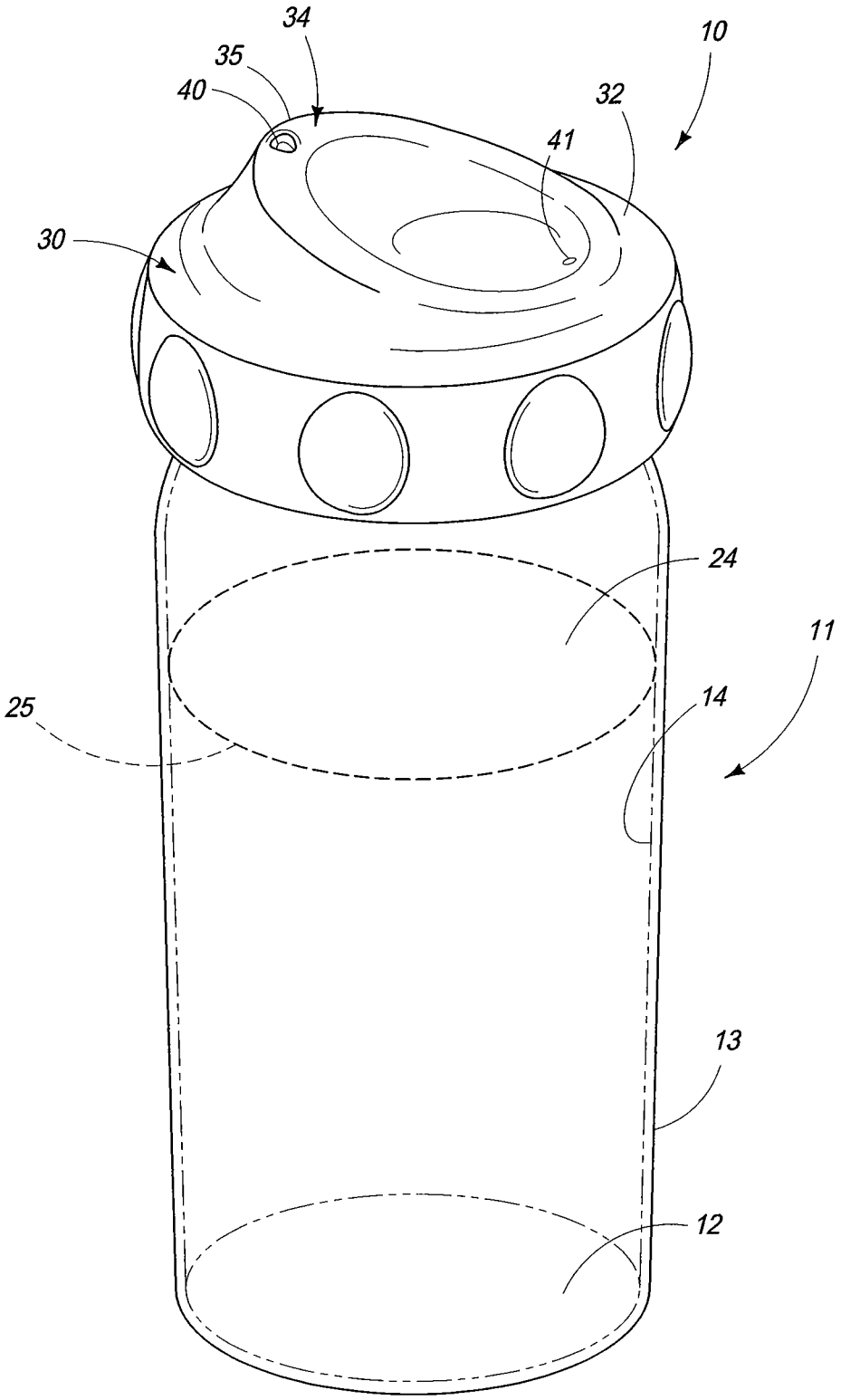
FIG. 1 is a perspective, side elevation view of the liquid metering assembly of the present invention, and which is shown in a typical operational environment.
Figure 3A:
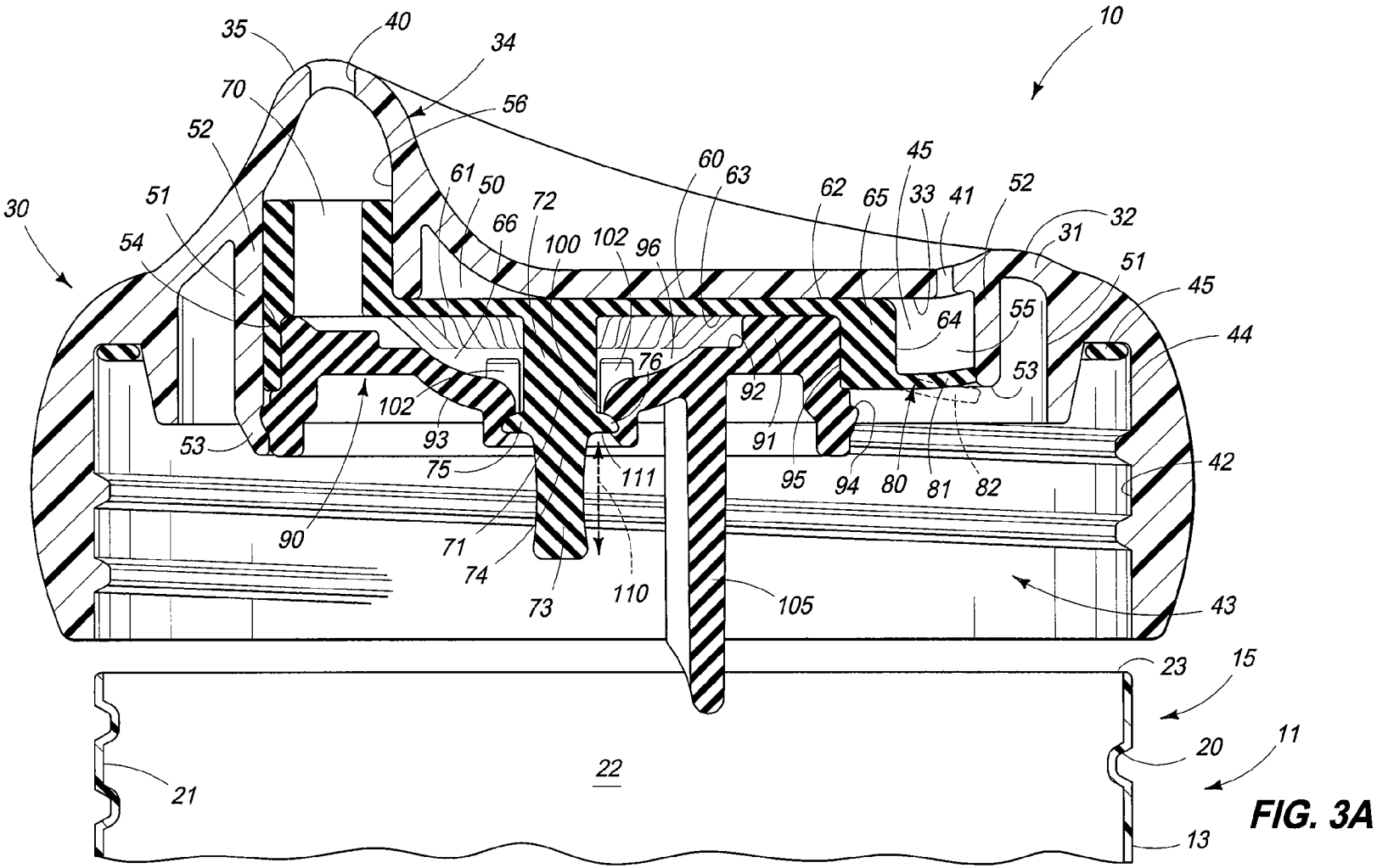
FIG. 3A is a transverse, vertical, sectional view taken from a position along line 3A-3A of FIG. 2 and which shows the liquid metering assembly in a first operational position.
Figure 3B:
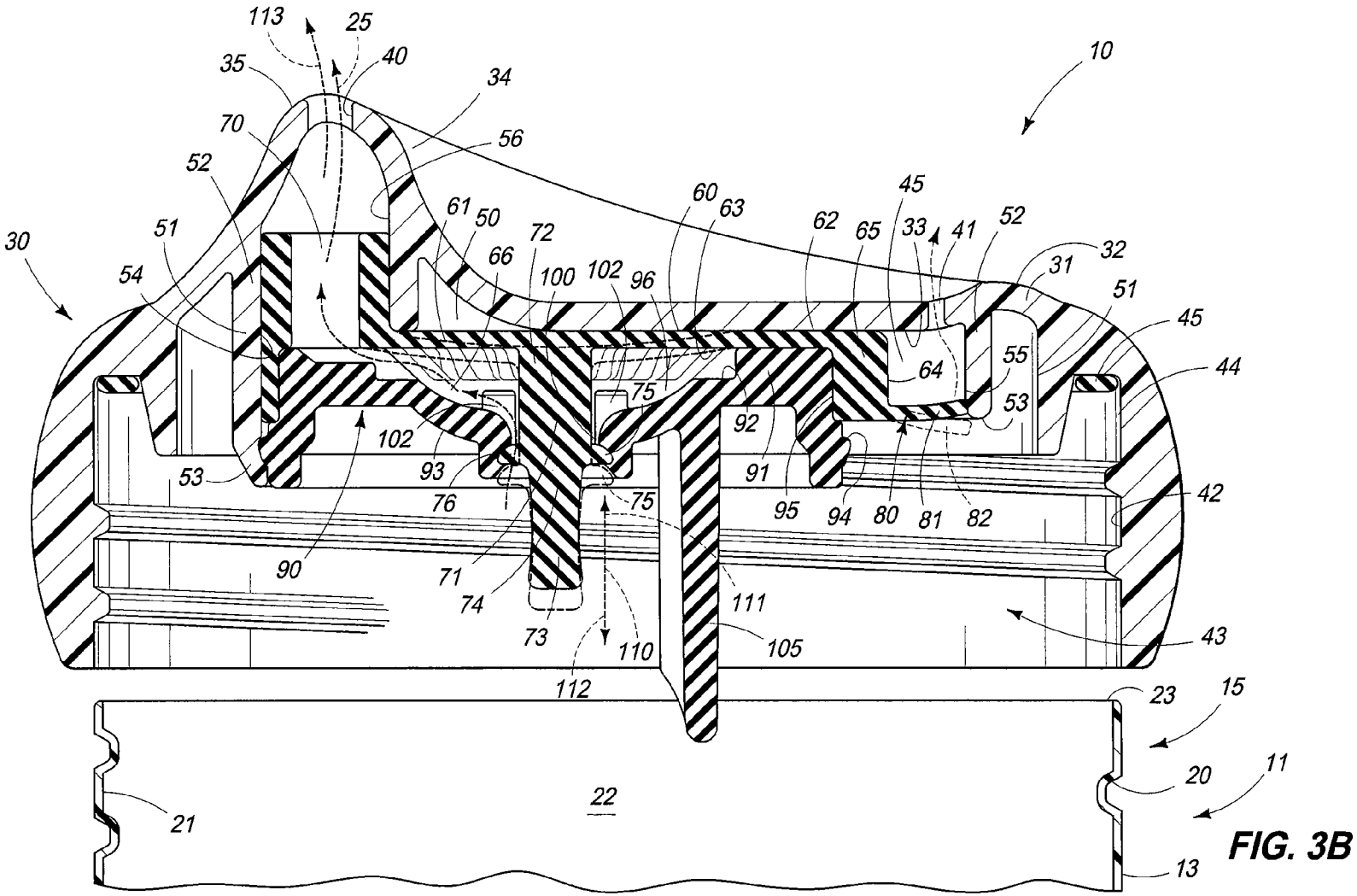
FIG. 3B is a transverse, vertical, sectional view taken from a position along line 3B-3B of FIG. 2 and which shows the liquid metering assembly in a second operational position.

A liquid metering assembly of the present invention is generally indicated by the numeral 10 in FIG. 1, and following. The liquid metering assembly 10 is useful when used in combination with a beverage container of substantially conventional design 11, and which can be releasably secured in an adjacent relationship relative thereto. In particular, the beverage container 11 as seen in FIGS. 1 and 3A and 3B, respectively, includes a bottom surface 12 which is operable to support the beverage container on an underlying supporting surface, not shown. The beverage container 11 further has a substantially continuous sidewall 13 which is sealably mounted or made integral with the bottom surface 12, and which extends upwardly therefrom. The continuous sidewall 13 has an inside facing surface 14. Further the continuous sidewall has an upper neck portion which is generally indicated by the numeral 15. The upper neck portion 15 is defined, at least in part, by a threaded exterior portion 20 which is operable to threadably, and releasably mate with a container cap which will be described in greater detail, hereinafter. The neck portion 15 further has an inside facing surface 21 which defines a neck passageway 22 having a given cross sectional dimension. Still further, the neck passage way 22 is defined, in part, by a top peripheral edge 23 as best seen in FIGS. 3A and 3B, respectively. The inside facing surface 21 of the continuous sidewall 13 defines an internal cavity 24 (FIG. 1) which is operable to enclose a source of the liquid to be consumed, or dispensed, and which is generally indicated by the numeral 25.

Figure 2:
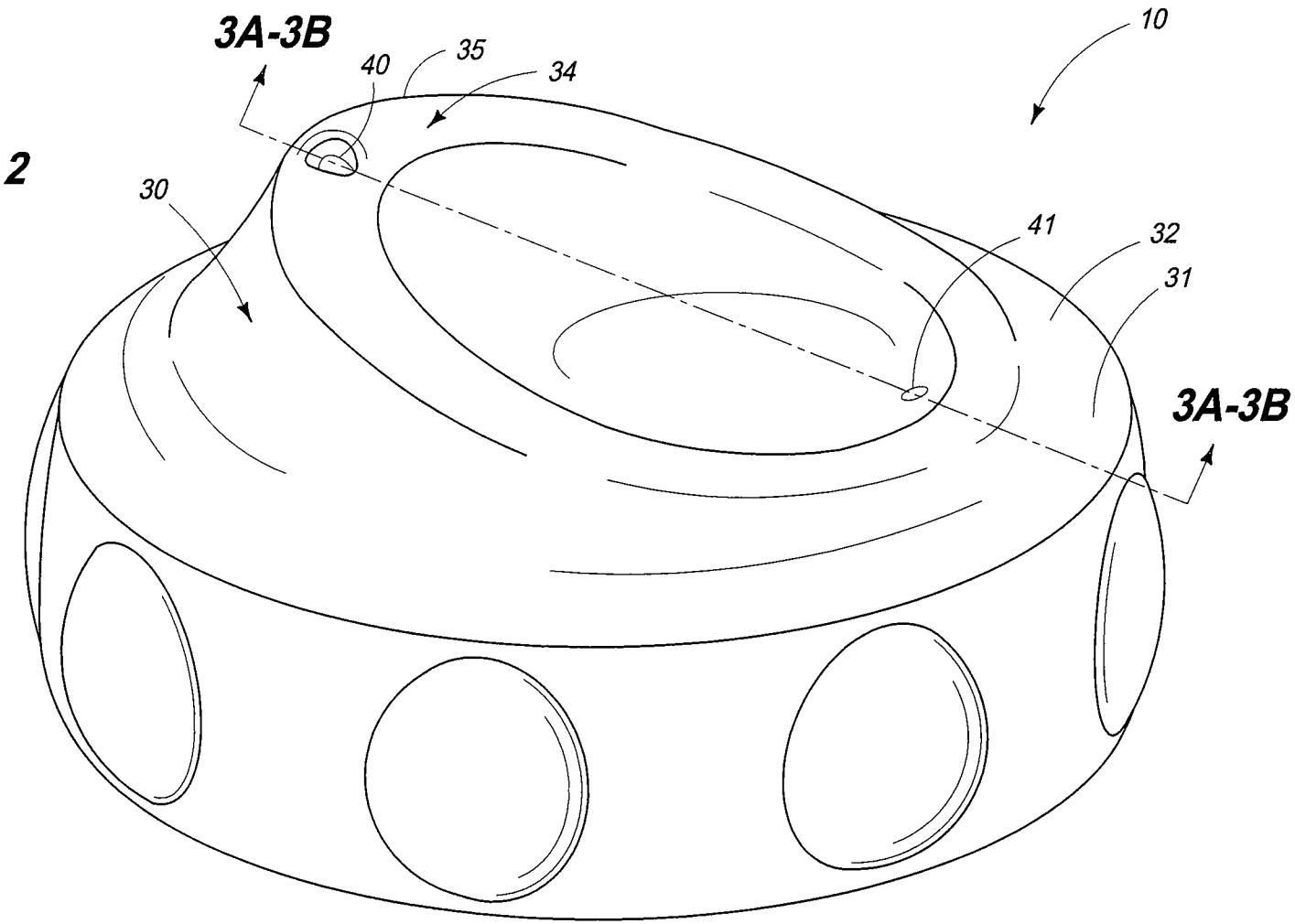
FIG. 2 is a greatly enlarged, fragmentary, perspective view of a container cap which incorporates the features of the present invention.

A container or drinking cap which is generally indicated by the numeral 30 is provided, and which is releasably engagable with the neck portion 15, as earlier described. The drinking cap (FIG. 2) has a main body 31 having an outside facing surface 32, and an opposite inside facing surface 33 (FIG. 3A). The outside facing surface defines a drinking spout which is generally indicated by the numeral 34, and which extends upwardly relative to the outside facing surface 32. The drinking spout has a distal end 35 which is dimensioned to be comfortably received within the mouth of a user, not shown. As will be discussed, hereinafter, and during use of the liquid metering assembly 10, a user (not shown) would apply suction by means of their mouth to the distal end 35 of the drinking spout to achieve the benefits of the present invention. The distal end 35 further has a drinking aperture 40 which is formed therein. Still further, a vent aperture 41 is formed in the main body 31, and extends between the outside facing surface 32, and the inside facing surface 33. The vent aperture 41 is operable to couple a surrounding ambient environment with the internal cavity 24 as defined by the beverage container 11.

Figure 4:
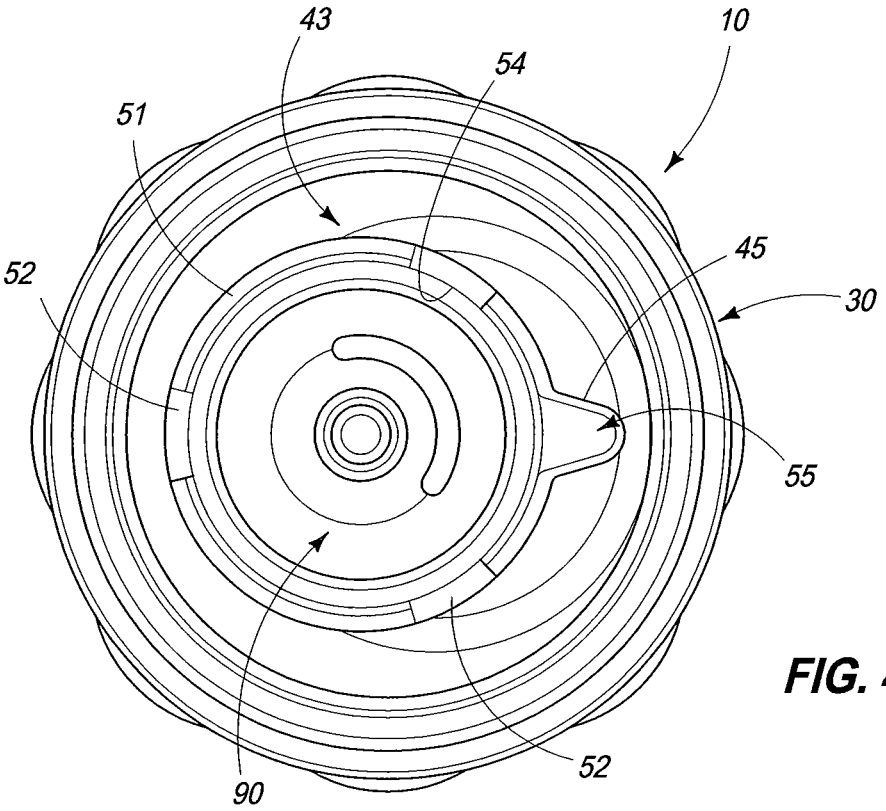
FIG. 4 is a bottom, plan view of the container cap as seen in FIG. 1.
Figure 5:
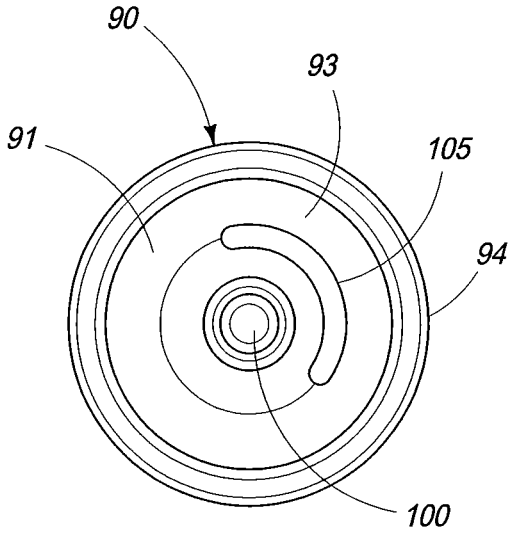
FIG. 5 is a bottom, plan view of a liquid volume control member which forms a feature of the present invention.
Figure 6:
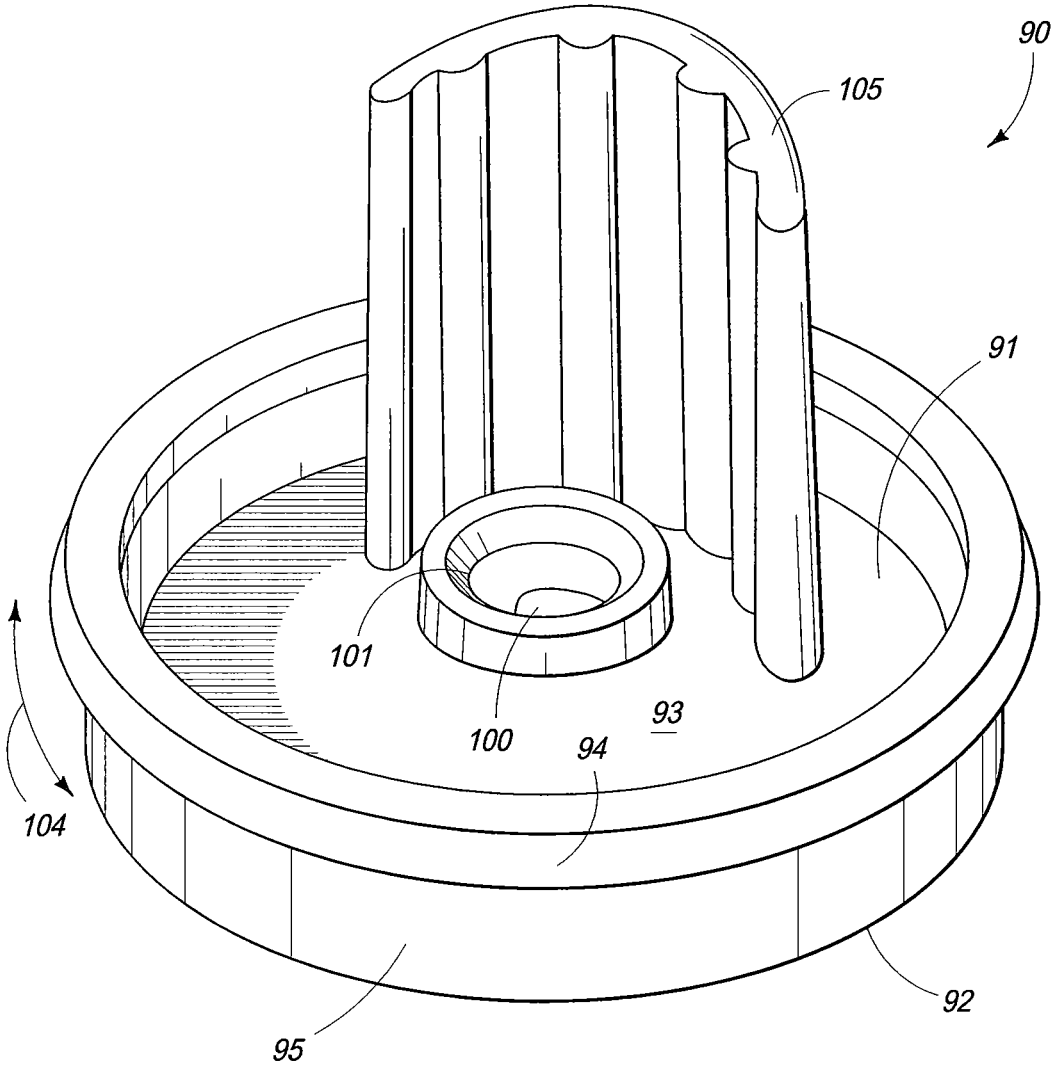
FIG. 6 is a perspective, side elevation view of a second form of the liquid volume control member, which forms a feature of the present invention.

As best seen by references to FIGS. 3A and 3B, the container or drinking cap 30 has an inside threaded sidewall portion 42 which is defined, in part, by the inside facing surface 33. The threaded sidewall portion 42 is arranged so as to conveniently, threadably mate with the threaded, exterior portion 20 as defined by the neck portion 15 of the beverage container 11. The inside threaded sidewall portion 42 defines a first cavity 43, which receives and cooperates, at least in part, with a portion of the neck 15 of the beverage container 11. As seen in FIGS. 3A and 3B, the first cavity 43 further defines a substantially circular-shaped channel 44. The channel 44 is operable to receive a resilient, elastomeric O-ring seal 45 therein, and in a manner which is well known in the art. Still further, a reduced dimensioned second cavity 50 communicates with the first cavity 43, and is further defined by a downwardly depending sidewall which is generally indicated by the numeral 51. This downwardly depending sidewall 51 has a first end 52, which is mounted on or made integral with the inside facing surface 33 of the container or drinking cap 30. Further, the downwardly depending sidewall 51 has an opposite second end 53, as illustrated in FIGS. 3A, 3B and FIG. 4, respectively. The second end 53 is somewhat curved and extends substantially inwardly, in the first form of the invention, thereby providing a means for releasably capturing and positioning a moveable diaphragm, and a liquid volume control member in an appropriate operational orientation as will be discussed in greater detail in the paragraphs which follow. The downwardly depending sidewall 51 also has an inside facing surface 54 which is generally cylindrical or circular in shape. As best seen by reference to FIG. 4, the downwardly depending sidewall further defines, at least in part a radially extending space 55. As seen in FIG. 3A, the vent aperture 41 communicates with the space 51. As will be recognized by a study of the drawings, the drinking aperture 40 and the vent aperture 41 communicate in fluid flowing relation with the second cavity 50. Still further, the drinking spout 34 defines at least in part a fluid passage way 56 which extends from the second cavity 50 to the drinking aperture 40, as earlier described.

Figure 9:
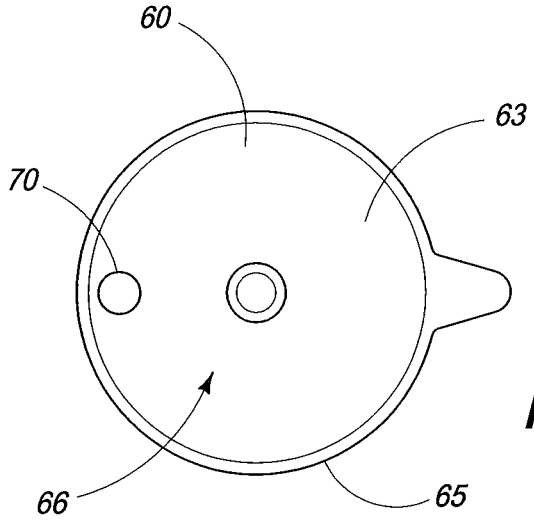
FIG. 9 is a bottom, plan view of a moveable diaphragm which forms a feature of the present invention.
Figure 10:
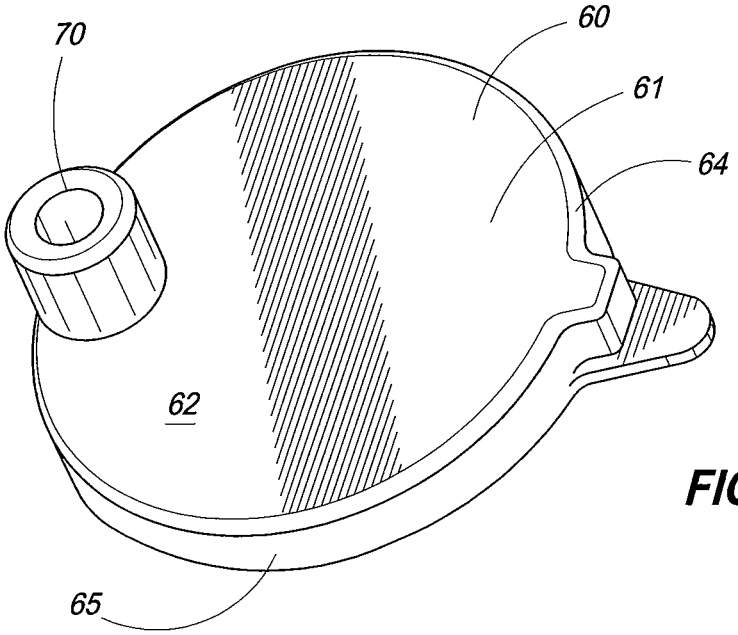
FIG. 10 is a perspective view of the top surface of a diaphragm which forms a feature of the present invention.
Figure 11:
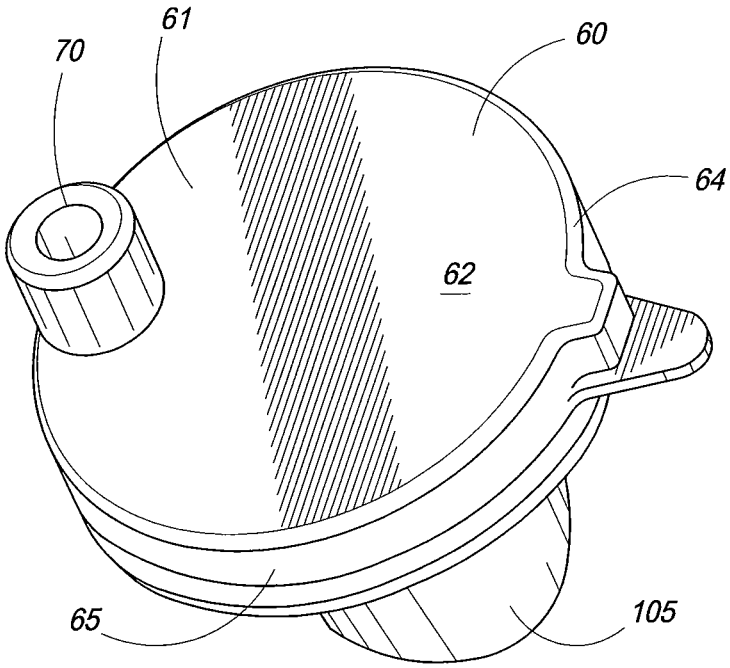
FIG. 11 is a perspective, side elevation view showing a diaphragm which releasably, matingly cooperates with an underlying liquid volume control member in an assembled configuration.
Figure 12:
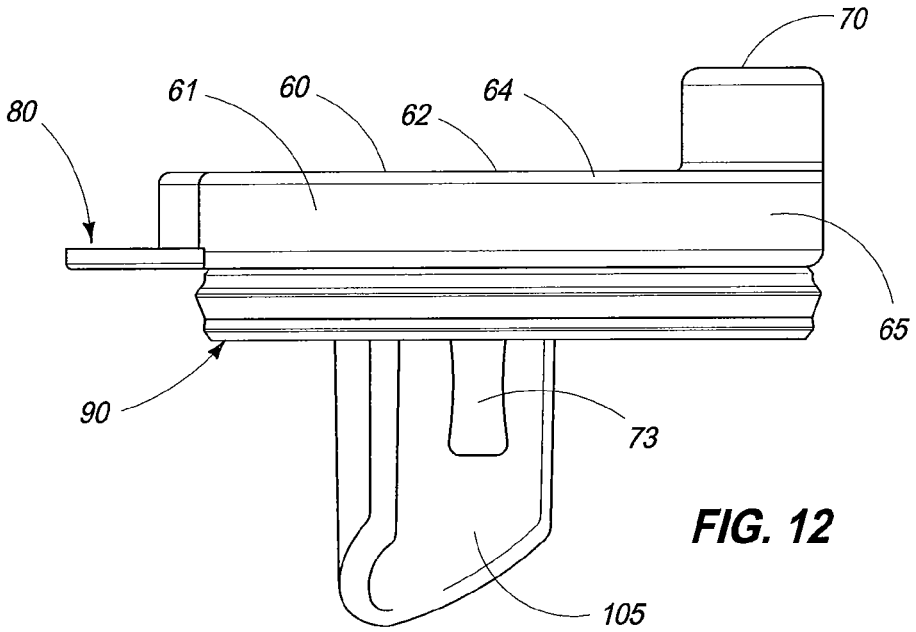
FIG. 12 is a first side elevation view showing a moveable diaphragm which is appropriately matingly cooperating with an underlying liquid volume control member.
Figure 13:
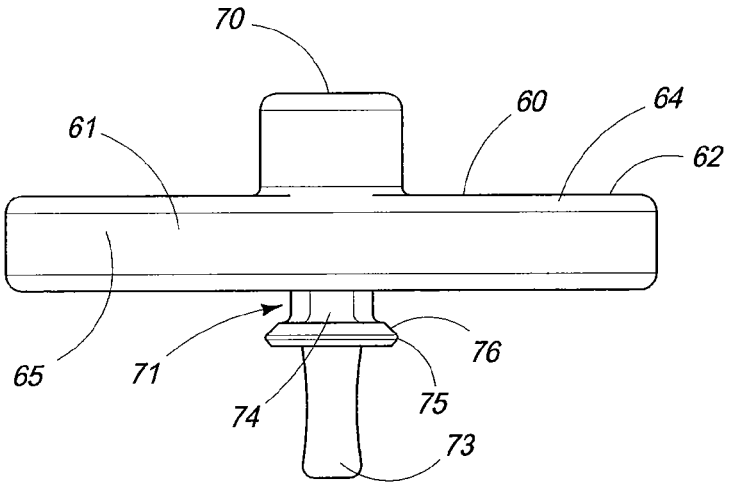
FIG. 13 is a side elevation view of a diaphragm which is a feature of the present invention.
Figure 14:
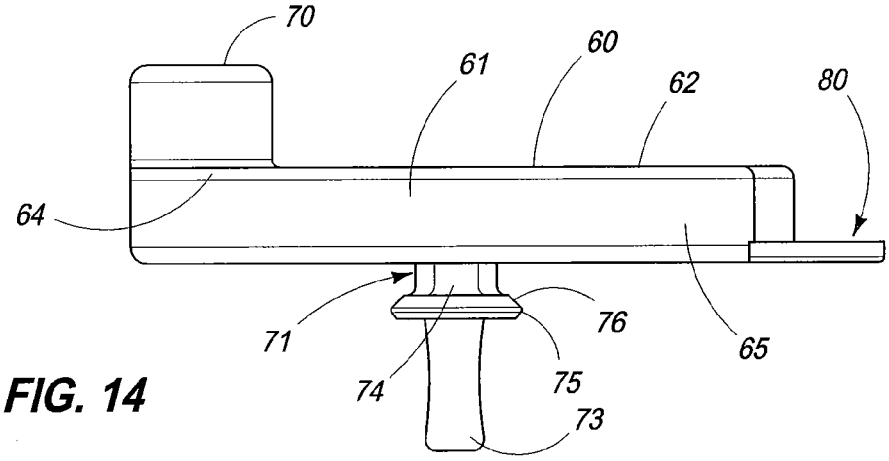
FIG. 14 is a second side elevation view of the diaphragm taken at a location of approximately 90° offset from that seen in FIG. 14.

The present invention 10 includes, as one of its features, a moveable diaphragm which is generally indicated by the numeral 60, in FIG. 3A, and following. The moveable diaphragm releasably cooperates with the container cap or drinking cap 30, and is coupled in fluid flowing relation relative to the dispensing aperture 40. The moveable diaphragm has a main body 61 (FIG. 13) which is defined by an outside facing surface 62, and which has a predetermined cross-sectional dimension, and an opposite, inside facing surface 63 (FIG. 9). The main body 61 has a substantially circular peripheral edge 64, and the main body 61 is dimensioned to be releasably, sealably received within the reduced dimensioned second cavity 50, that was described, above. A downwardly extending sidewall 65 is located along the peripheral edge 64, and further defines an internal cavity which is generally indicated by the numeral 66 (FIG. 9). The main body is fabricated from a resilient elastomeric material which can be easily cleaned.

The moveable diaphragm 60 further defines a second, fluid passageway 70 which extends upwardly from the outside facing surface 62 of the diaphragm 56. The second fluid passageway is telescopingly and releasably fluid sealably received and secured, at least in part, within the fluid passage way 56 that is defined, at least in part, by the drinking spout 34. Additionally, the moveable diaphragm 60 includes an elongated valve member which is generally indicated by the numeral 71, and which depends substantially, normally downwardly, from the inside facing surface 63. The valve member has a first end 72 (FIG. 3A) which is affixed to, or made integral with the inside facing surface 63, and an opposite second, or distal end 73, which depends or extends downwardly from the outside facing surface 62, and into the first cavity 43. Additionally, the elongated valve member 71 has an intermediate portion 74. Made integral or attached to the intermediate portion 74 is a valve portion 75 having a predetermined outside diametral dimension, and an engagement surface 76, which is operable to sealably engage a liquid volume control member in a manner which will be discussed in greater detail, hereinafter. Additionally, as seen in FIG. 4 and following, the moveable diaphragm 60 further includes a moveable vent flap 80 which extends radially outwardly relative to the downwardly extending sidewall 65, and is further positioned in a selective, covering or blocking relationship relative to the generally radially extended space 55. The moveable vent flat 80, is operable to move between a first position 81, (FIG. 3A), whereby the moveable vent flap 80 is positioned in substantially occluding relation relative to the vent aperture 41, and thereby prevents the source of liquid to be consumed or dispensed 25 from escaping from the beverage container 11; to a second position 82 which allows a surrounding ambient environment to communicate with the internal cavity 24 of the beverage container 11. The operation of the diaphragm 60 will be discussed in greater detail, hereinafter.

Figure 7:
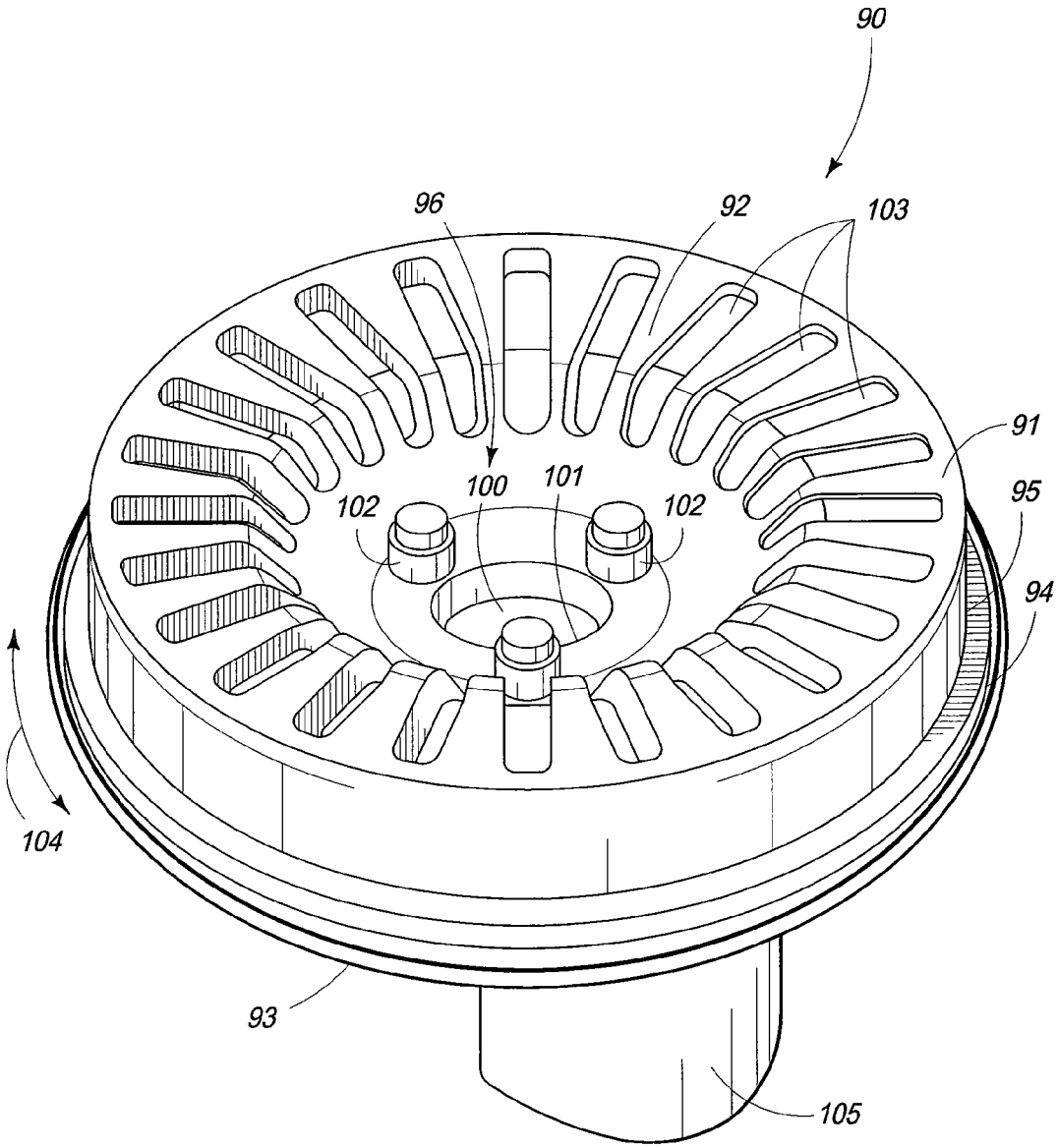
FIG. 7 is a perspective view of the top surface of a liquid volume control member which forms a feature of the present invention.
Figure 8:
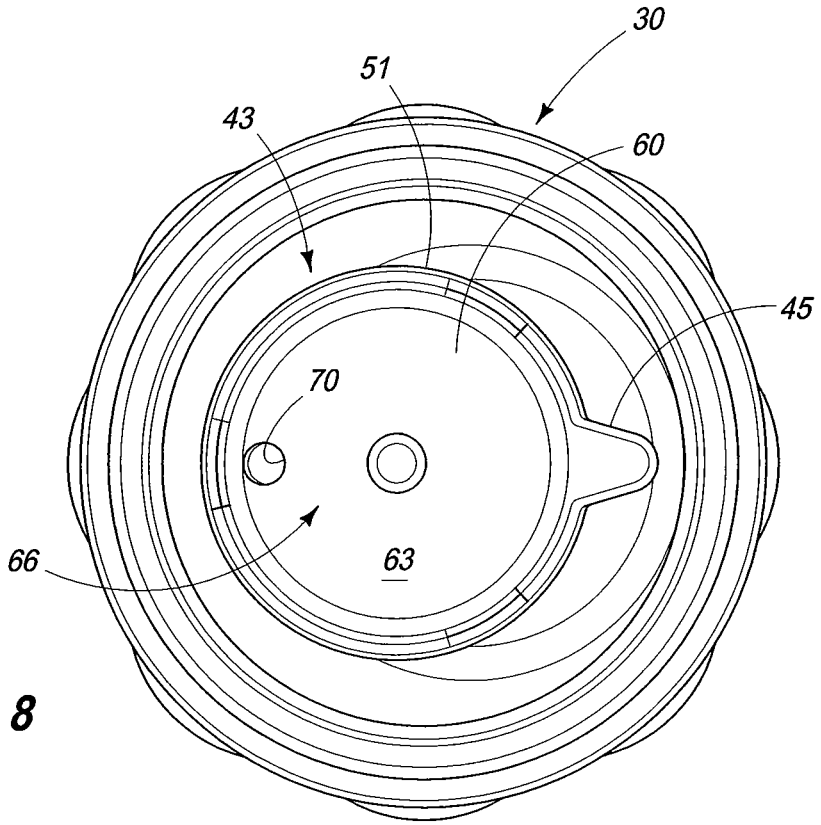
FIG. 8 is a fragmentary, bottom plan view of a container cap as seen in FIG. 1.

The present invention further includes, as one of its features, a moveable or adjustable liquid volume control member which is generally indicated by the numeral 90, and which sealably, matingly, and operably cooperates with the moveable diaphragm 60, and which provides a convenient means which allows a user of the invention 10 to selectively, adjustably, and easily control the volume of the source of liquid 25 which is released from the beverage container 11. This functional attribute has not been possible, heretofore. The liquid volume control member 90 has a main body 91, which is defined by an outside or top surface 92, and a bottom or inside facing surface 93. Still further the main body is defined by a peripheral edge 94 defining a seat 95 which is operable to releasably, sealably receive, or otherwise conformably mate with, the downwardly extending sidewall 65 of the moveable diaphragm. Still further, the top surface 92 defines a concavely shaped liquid receiving chamber which is generally indicated by the numeral 96 (FIG. 7). As best illustrated in FIG. 7, a fluid flowing aperture 100 is formed in the main body 91, and extends between the top and bottom surfaces 92 and 93 respectively. The liquid 25 passes through the aperture 100 on its way to the drinking spout 34. As seen in FIGS. 3A and 3B, a frusto conically shaped or appropriately molded seal seat 101 is formed in the main body 91, and is located near the inside facing surface, or bottom surface 93. This seat is operable to sealably mate with the valve portion 75 of the elongated valve member 71 in a fashion which will be described in greater detail, below. Still referring to FIG. 7, a multiplicity of movement limiting members 102 are mounted on the top surface 92, and are located adjacent to, and surrounding the fluid flowing aperture 100. The movement limiting members 102 engage and otherwise restrict the moveable diaphragm 60 to prevent the moveable diaphragm 60, from occluding or otherwise blocking the fluid flowing aperture 100. This feature of the invention will be discussed in greater detail below. Additionally, as will be seen in FIG. 7, a multiplicity of fluid flowing channels 103 are formed in the top surface 92, and extend generally radially, outwardly, from the liquid receiving chamber 96, and towards the peripheral edge 94. The multiplicity of fluid flowing channels 103 each have variable dimensions, that is either length, width, or depth, or combinations of the above. As seen in FIG. 7, some channels 103 have a shallow depth dimension and others have a relatively deep depth dimension. In other words, the main body 91 of the liquid volume control member 90 has a variable thickness and thereby forms channels 103 of one or more varying dimensions. During operation, and when properly assembled, at least one of the fluid flowing channels 103 is positioned in fluid flowing relation relative to the fluid passageway 56 which is defined at least in part by the drinking spout 34. The respective fluid flowing channels 103 have a length dimension of about 15 mm.; a width dimension of about 1.8 mm; and a depth dimension of about 0.2 mm. to about 4 mm. It should be understood that the main body 91 is sealably secured in the internal cavity 66 as defined by the moveable diaphragm 60, but is selectively rotatably moveable relative thereto by a user as shown by the path of movement which is labeled 104. In view of the variable dimensions of the multiplicity of fluid flowing channels 103, a user of the present invention 10 can position or otherwise orient an appropriate fluid flowing channel to provide a given volume of liquid 25 to be delivered to the drinking spout 34. In the arrangement as seen in the drawings, and in particular with respect to FIGS. 3A and 3B, a finger grip 105 is provided, and which may be grasped by a user in order to facilitate the rotation of the main body 91, and along the path of travel 104 so as to align a given fluid flowing channel, or channels 103, so as to deliver the desired amount of liquid 25 to the drinking spout 34.

Referring now to FIGS. 3A and 3B it should be understood that the moveable diaphragm 60 of the present invention is typically fabricated from a resilient, elastomeric polymer which is flexible and which will distort, or otherwise move under the influence of a suction force which is applied to the drinking spout 34 as will be described in more detail, below. More specifically, and when assembled, it is understood from the drawings that the moveable or adjustable liquid volume control member 90 is fluid sealingly received, and matingly couples with the moveable diaphragm 60. Further the moveable diaphragm 60 is fluid sealingly received within the reduced dimensioned second cavity 50 which is defined by the container or drinking cap 30. When properly aligned, the second fluid passageway 70 is fluid sealably received within the fluid passageway 56 which is defined, in part, by the drinking spout 34. The moveable diaphragm 60, can be moved along a path of travel or movement 110 (shown in phantom in FIG. 3B) between a first seated position 111, as best seen in FIG. 3A, and wherein in the first position 111 the valve portion 75, and more specifically the engagement surface 76, sealably mates thereagainst the seat 101 which forms a portion of the fluid flowing aperture 100, of the liquid valve control member 90. In this position, the valve member 71 impedes, or otherwise prevents the passage of any liquid 25 from the drinking vessel 11. Simultaneously, the moveable vent flap 80 is positioned in substantially occluding relation in a first position 81, and which prevents liquid 25 from escaping from the beverage container 11, and passing through the vent aperture 41 in the event that the beverage container 11 is overturned by the action of a user, or otherwise. In the event that a user (not shown) wishes to drink or otherwise consume or dispense the liquid 25, a suction 113 is applied by the mouth of the user to the drinking spout 34. The elongated valve 71 is then moveable to a second, displaced, fluid flowing position 112 as seen in phantom lines in FIG. 3B under the influence of ambient air pressure in view of the vacuum created in the beverage container 11 by the suction created by the users. In order to move to the second, fluid flowing position 112. The suction 113 which is applied, causes the main body 61 of the moveable diaphragm 60 to move or be drawn away from the inside facing surface 33 of the drinking cap 30. In this displaced orientation, fluid, 25, can then move between the valve portion 75, and into the liquid receiving chamber 96 of the liquid valve control member 90. Once received in the liquid receiving chamber 96, the liquid 25 can then travel, along any of the previously described fluid flowing channels 103 which were previously aligned with the second fluid passageway 70, and thereby pass out through the drinking aperture 40 for use by the user, not shown. As earlier described, the liquid valve control member 90 includes a plurality of movement limiting members 102 which prevents the main body 91 from distorting, or otherwise being displaced to a position where it might be oriented in occluding or covering relationship relative to the fluid flowing aperture 100. As the suction 113 is being applied, the moveable vent flap 80 moves from the first position 81, to a second position 82 where it is oriented in a partially, nonoccluding position, and thereby allows an outside ambient environment to communicate with the internal cavity 24 of the beverage container 11. This movement allows the ambient atmosphere to equalize the air pressure within the beverage container 11, and thus allows for the smooth flow of the liquid 25 through the liquid metering assembly 10, and to the drinking aperture 40. When the suction 113 is withdrawn or stops, the elongated valve member 71 moves back, resiliently, to the first position 111 thereby impeding any movement of the fluid 25 from the beverage container 11 in the event that the beverage container is overturned accidently. Further, the vent flap 80 returns to first position 81 thereby preventing the escape of liquid 25 through the vent aperture 41.

Second Form

Figure 15:
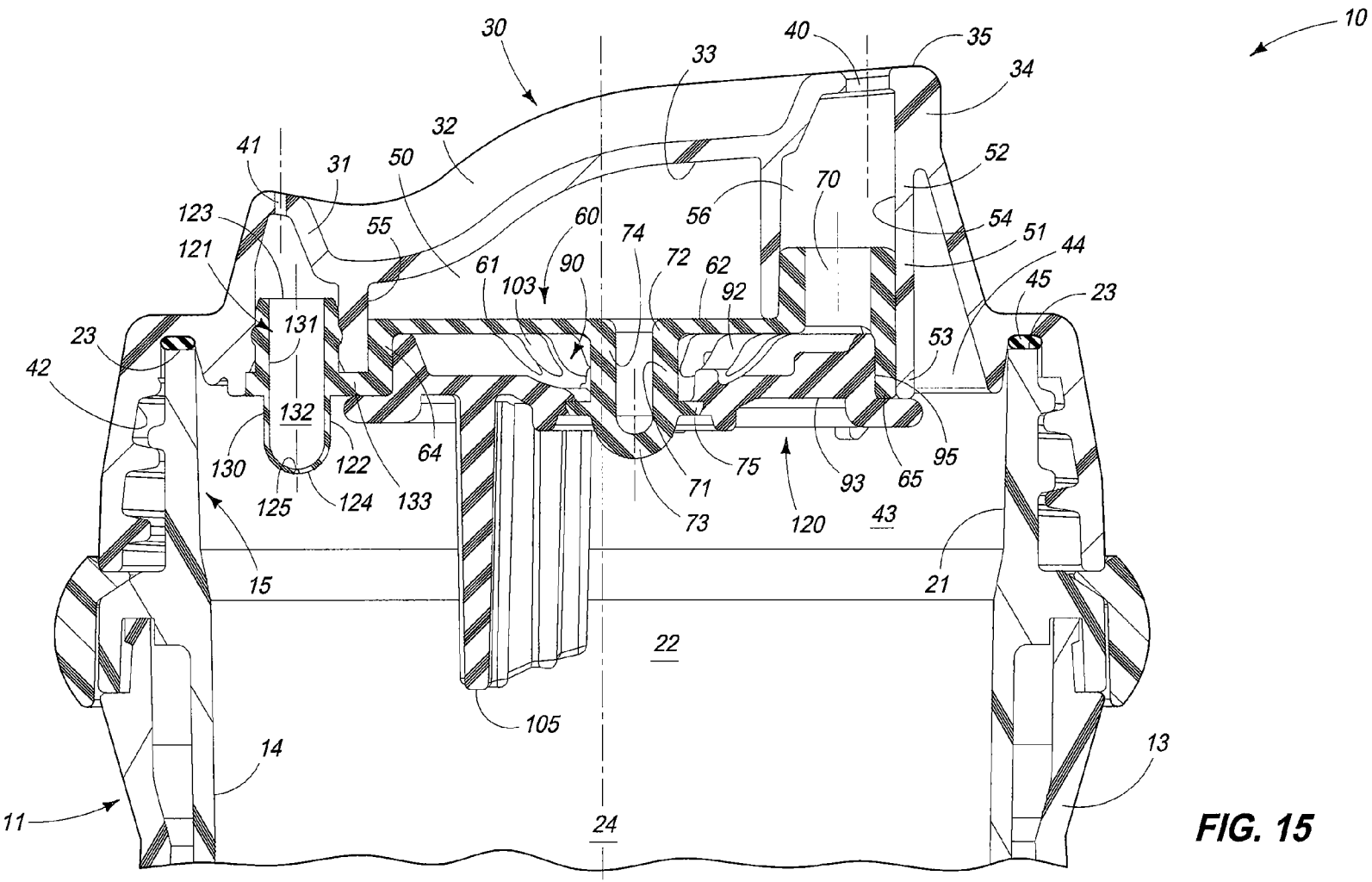
FIG. 15 is a transverse, vertical sectional view taken from a position along line 3A-3A of FIG. 2 and which shows a second form of the present invention.

Referring now to FIG. 15, a second form of the invention which is generally indicated by the numeral 120, is shown. In this form of the invention 120, similar structures bear like numbers from that seen with respect to the first form of the invention as illustrated in FIGS. 1-14. Therefore, for purposes of brevity, only the new structure as found in the second form of the invention 120, is discussed in the paragraph which follows.

In the second form of the invention 120, the moveable diaphragm which was generally discussed, and referred to by the numeral 60 in the earlier paragraphs of this application, has been modified to include a slit valve which is generally indicated by the numeral 121, this structure replaces the earlier-described vent flap which was designated by the numeral 80 in FIGS. 1-14, respectively. The slit valve 121 has a flexible, or resilient main body 122, which has a first end 123, and an opposite second end 124. The slit valve 121 has formed in the second end 124 a passageway 125. In operation, the slit valve passageway 125 is opened or otherwise placed in nonoccluding position relative to the drinking aperture 40 when exposed to a pressure differential which exists between the internal cavity 24 of the drinking vessel 11, and the external ambient environment as may be caused by a suction placed on the drinking aperture 40, by a user's mouth. This allows for the equalization of pressure and for the smooth flow of liquid from the beverage container 11. When the pressure is equalized the passageway 125 closes, and occludes the vent aperture 41, and thereby prevents the escape of any liquid from the internal cavity 24 by way of the vent aperture 41. The main body 122 of the slit valve 121 has an outside facing 130, which is dimensioned so as to be telescopingly, and fluid sealingly received in an interfitted, mating relationship relative to the cap 30, and placed in fluid flowing relation relative to the vent aperture 41. Additionally, the main body 122 has an inside facing surface 131, which defines an internal passageway 132 which extends between the first and second ends 123 and 124, respectively, and which allows the ambient environment pressure to pass through the vent aperture 41, and thereafter cause an opening of the liquid passageway 25. This permits the equalization of pressure between the ambient environment and the internal cavity of the drinking vessel. The main body 122 is connected to the side wall 65 of the diaphragm 60 by a flange portion 133, so as to be positioned in an appropriate orientation relative to the vent aperture 41. Otherwise, the second form of the invention 120 operates in a manner identical to that earlier disclosed with respect to the first form of the invention.

Operation

The operation of the described embodiment of the present invention is believed to be readily apparent and is briefly summarized at this point.

In its broadest aspect the present invention relates to a liquid metering assembly 10 which includes a container 11 enclosing a source of a liquid 25 to be dispensed. The liquid metering assembly 10 further includes a container cap 30 for engaging and enclosing the source of the liquid 25 within the container 11, and wherein the container cap 30 defines a dispensing aperture 40 and a vent aperture 41. In the form of the invention as disclosed, a moveable diaphragm 60 is provided and which releasably cooperates with the container cap 30, and is coupled in fluid flowing relation relative to the dispensing aperture 40. The moveable diaphragm 60 further has a valve member 71 which depends downwardly therefrom. Further the liquid metering assembly 10 of the present invention includes a moveable or selectively adjustable liquid volume control member 90 which fluid sealably, and matingly cooperates with the moveable diaphragm 60, and which further defines a liquid receiving chamber 96, and a fluid flowing aperture 100 which extends therethrough. The valve member 71 is received in the fluid flowing aperture 100, and is reciprocally moveable relative thereto when a suction 113 is applied to the dispensing aperture 40 of the container cap 30. As earlier discussed, a selective movement of the liquid volume control member 90 relative to the moveable diaphragm 60 can selectively vary the volume of the liquid 25 which is dispensed from the container 11 when a given amount of suction 113 is applied to the dispensing aperture 40.

More specifically the present invention relates to a liquid metering assembly 10 which includes a beverage container 11 having an internal cavity 24 for receiving a source of a liquid 25 to be consumed by a user (not shown) of the beverage container 11. The beverage container 11 has a neck portion 15 which communicates with the internal cavity 24 thereof. A drinking cap 30, is provided, and which is releasably engagable with the neck portion 15, and which has a drinking aperture 40 through which the source of liquid 25 may move from the internal cavity 24, and then be consumed by the user. A vent aperture 41 is formed in the drinking cap, and further couples a surrounding ambient environment with the internal cavity 24. A moveable diaphragm 60 matingly cooperates with a drinking cap 30, and further has an elongated valve member 71 which depends downwardly from the diaphragm 60, and which is further moveable therewith. Further the liquid metering assembly 10 includes an adjustable liquid volume control member 90, and which defines a liquid receiving chamber 96, and which is located in releasable, mating cooperation with the moveable diaphragm 60, and which is further disposed in fluid flowing relation relative to the drinking aperture 40. The liquid volume control member 90, defines a fluid flowing aperture 100 which extends through the liquid volume control member 90, and which couples the liquid receiving chamber 96 with the internal cavity 24 of the beverage container 11. The elongated valve member 71 extends through the fluid flowing aperture 100. When a suction 113 is applied by a user to the drinking aperture 40, this suction causes a reduced pressure or partial vacuum in the vessel 11. This reduced pressure or partial vacuum then causes the diaphragm 60 to move away from the drinking cap 30, and thereby urge or carry the elongated valve member 71 from a first seated sealed position 111, where the elongated valve member is positioned against the liquid volume control member 90, and substantially occludes the fluid flowing aperture 100, and which further prohibits the flow of the source of liquid 25 from the internal cavity 24 of the beverage container 11 to the drinking aperture 40, and by way of the fluid flowing aperture 100. The elongated valve member 71 is further moveable to a second, fluid flowing position 112, when the suction 113 is applied, and wherein in the second position 112, the elongated valve member 71 is displaced from the first seated position 111, and which facilitates the flow of the source of liquid 25 from the internal cavity 24 of the beverage container 11, and through the fluid flowing aperture 100, and then to the drinking aperture 40, and by way of the liquid receiving chamber 96. Again, the selective rotation or movement of the moveable or adjustable liquid valve control member 90 allows a user to set or predetermine, in advance, the amount and volume of the liquid 25 which may reach the drinking aperture 40. With this novel arrangement, a user, can for example, adjust the volume of liquid dispensed so as to allow them to train an infant, or child, for example to drink properly as their eating and swallowing skills develop.

In the arrangement as seen in the drawings, it will be understood that the assembly as described is easily taken apart, and cleansed, and then reassembled. Upon reassembling, it will be understood that the second or distal end 73 of the valve member is first pushed through the fluid flowing aperture 100, and then is grasped by the fingers of the user and pulled downwardly thereby causing the intermediate portion 74, bearing the valve portion 75, to be distorted and squeezed through the fluid flowing aperture 100 and into, the first seated position 111.

Therefore it will be seen that the present invention provides a convenient and novel means by which a user may adjust the flow of a liquid from a beverage container in a manner not possible, heretofore. Further, the present invention provides a novel means for sealing a drinking vessel so as to prohibit the accidental spilling of a liquid by the drinking vessel if accidentally overturned.

In compliance with the statute the present invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the Doctrine of Equivalence.

I claim:

1. A liquid metering assembly, comprising:

a container for enclosing a source of a liquid to be dispensed;

a container cap for engaging and enclosing the source of fluid within the container, and wherein the container cap defines a dispensing aperture, and a vent aperture;

a moveable diaphragm releasably cooperating with the container cap, and coupled in fluid flowing relation relative to the dispensing aperture, and wherein the moveable diaphragm further has a valve member; and a moveable liquid volume control member having a main body which has a thickness dimension which is variable, and which sealably, and matingly cooperates with the moveable diaphragm, and which further defines a liquid receiving chamber, and a fluid flowing aperture which extends therethrough, and wherein the liquid receiving chamber of the movable liquid volume control member further defines a multiplicity of fluid flowing channels which each have a predetermined length and width dimension, and a variable depth dimension as defined by the variable thickness dimension of the main body of the liquid volume control member, and which are further individually oriented in fluid receiving relation relative to the fluid flowing aperture, and wherein the valve member is received in the fluid flowing aperture, and is moveable relative thereto when a suction is applied to the dispensing aperture of the container cap, and wherein a selective movement of the liquid volume control member relative to the moveable diaphragm orients one of the multiplicity of fluid flowing channels in fluid receiving relation relative to the fluid flowing aperture, and in fluid delivering relation relative to the dispensing aperture of the container cap, and wherein the selective movement of the liquid volume control member relative to the moveable diaphragm varies a volume of the liquid which is dispensed from the container when a given amount of suction is applied to the dispensing aperture; and a movement limiting member defined by the moveable liquid volume control member and which is positioned in the liquid receiving chamber thereof, and which limits the motion of the movable diaphragm relative to the moveable liquid volume control member.

2. A liquid metering assembly as claimed in claim 1, and wherein the container is a beverage container, and the source of the liquid to be dispensed is a liquid which can be consumed by a user of the beverage container, and wherein the container cap comprises a drinking cap which defines a drinking spout, and the dispensing aperture comprises a drinking aperture, and wherein the suction is applied by a user's mouth to the drinking aperture of the beverage container.

3. A liquid metering assembly as claimed in claim 2, and wherein the drinking cap has a main body having an outside facing surface, and an opposite, inside facing surface, and wherein the inside facing surface defines a first cavity which releasably, matingly cooperates with the beverage container, and which further defines a reduced dimensioned, second cavity, which is defined, at least in part, by a downwardly depending sidewall which is mounted on the inside facing surface of the drinking cap, and wherein the drinking spout defines a fluid passageway which communicates with the second cavity, and the vent aperture communicates in fluid flowing relation relative to the second cavity.

4. A liquid metering assembly as claimed in claim 3, and wherein the movable diaphragm further includes a moveable flap which selectively occludes the vent aperture when the liquid metering assembly is in operation.

5. A liquid metering assembly is claimed in claim 3, and wherein the moveable diaphragm further includes a slit valve which selectively occludes the vent aperture when the liquid metering assembly is in operation.

6. A liquid metering assembly as claimed in claim 3, and wherein the downwardly extending sidewall is substantially circular shaped and further defines a generally radially extending space which communicates with the second cavity, and wherein the vent aperture communicates with the radially extending space, and wherein the moveable diaphragm is fluid sealably received, at least in part, within the second cavity.

7. A liquid metering assembly as claimed in claim 6, and wherein the moveable diaphragm has a main body which is defined by an outside facing surface, and an opposite inside facing surface, and wherein a second fluid passageway extends upwardly from the outside facing surface of the moveable diaphragm, and is further telescopingly and fluid sealably received, at least in part, within the fluid passageway which is defined, at least in part, by the drinking spout, and wherein the valve member is elongated in shape, and further extends normally, downwardly, from the inside facing surface of the moveable diaphragm, and wherein the elongated valve member has a distal end, and an intermediate portion, and wherein a valve portion is made integral with the elongated valve member and is located on the intermediate portion, and wherein a slit valve is located in spaced, selectively occluding, outwardly disposed relation relative to the sidewall of the main body, and is oriented in covering relation relative to the radially extending space which is defined, at least in part, by the downwardly depending sidewall.

8. A liquid metering assembly as claimed in claim 7, and wherein each of the multiplicity of fluid flowing channels extend substantially radially outwardly from the liquid receiving chamber, and towards the peripheral edge, and wherein a finger grip extends downwardly from the bottom surface of the main body and facilitates the selective positioning of the liquid volume control member relative to the moveable diaphragm, and wherein the top surface of the main body of the liquid control member is received, at least in part, within the internal cavity as defined by the moveable diaphragm, and the elongated valve member is received within, and is moveable relative to, the fluid flowing aperture.

9. A liquid metering assembly as claimed in claim 8, and wherein the distal end of the elongated valve member depends downwardly relative to the bottom surface of the liquid volume control member, and wherein the valve portion sealably seats thereagainst, and occludes the fluid flowing aperture as defined by the liquid volume control member when located in a first, seated position, and wherein in the first, seated position, the source of the liquid contained within the beverage container cannot pass through the fluid flowing aperture, and be received in the liquid receiving chamber, and wherein the elongated valve member is moveable to a second, fluid flowing position which is displaced from the first, seated position, and which further permits the source of the liquid received within the beverage container to pass through the fluid flowing aperture, and into the liquid receiving chamber, and wherein the elongated valve member moves between the aforementioned first and second positions when the user applies a suction to the drinking aperture, and which causes the moveable diaphragm to move away from the drinking cap, and then subsequently carry the elongated valve member from the first to the second position.

10. A liquid metering assembly as claimed in claim 9, and wherein the suction supplied to the drinking aperture is effective in opening the slit valve relative to the vent aperture, and wherein the slit valve, upon the application of the suction moves from a first, occluding position relative to the vent aperture, and wherein, in the first occluding position, the source of the liquid contained in the beverage container is prevented from escaping the beverage container by way of the vent aperture, to a second non-occluding position, and wherein, in the second non-occluding position, the vent aperture is at least partially non-occluded so as to facilitate communication of the internal cavity of the beverage container with a surrounding ambient environment.

11. A liquid metering assembly as claimed in claim 10, and wherein the fluid flowing channels have a width dimension of about 1.8 mm; a length dimension of about 15 mm; and a depth dimension of about 0.2 mm to about 4 mm.

12. A liquid metering assembly comprising:

a beverage container having an internal cavity for receiving a source of a liquid, and wherein the beverage container has a neck portion which communicates with the internal cavity thereof;

a drinking cap which is releasably engageable with the neck portion, and which has a drinking aperture through which the source of liquid may move from the internal cavity, and then be consumed by a user, and a vent aperture which couples a surrounding ambient environment with the internal cavity, and wherein a portion of the drinking cap defines a fluid passageway which communicates with the drinking aperture;

a moveable diaphragm matingly cooperating with the drinking cap, and further having an elongated valve member which depends downwardly from the diaphragm, and which is further moveable therewith; and an adjustable liquid volume control member that defines a liquid receiving chamber, and wherein the adjustable liquid volume control member is located in releasable, mating and rotatably movable cooperation with the moveable diaphragm, and which is further disposed in fluid flowing relation relative to the drinking aperture, and wherein the liquid volume control member defines a fluid flowing aperture which extends through the liquid volume control member, and which couples the liquid receiving chamber with the internal cavity of the beverage container, and wherein the elongated valve member extends through the fluid flowing aperture, and wherein the adjustable liquid volume control member has a main body defined by a peripheral edge, a top surface and a bottom surface, and wherein the top surface defines the liquid receiving chamber, and wherein the fluid flowing aperture is formed in the main body and extends therethrough, and wherein a multiplicity of fluid flowing channels are formed in the top surface, and wherein the multiplicity of fluid flowing channels each has a dimension distinct from the other fluid flowing channels, and wherein at least one of the fluid flowing channels is positioned in fluid flowing relation relative to the fluid passageway, and wherein the main body is configured to be selectively, and sealably rotated relative to the moveable diaphragm so as to allow for dispensing of a volume of the source of the liquid, and wherein a suction applied to the drinking aperture causes the diaphragm to move away from the drinking cap, and thereby urge the elongated valve member from a first, seated, and sealed position, where the elongated valve member is positioned against the liquid volume control member, and occludes the fluid flowing aperture, and which further prohibits the flow of the source of the liquid from the internal cavity of the beverage container to the drinking aperture, and by way of the fluid flowing aperture; to a second, fluid flowing position, and wherein, in the second position, the elongated valve member is displaced from the first, seated position, and which facilitates the flow of the source of the liquid from the internal cavity of the beverage container, and through the fluid flowing aperture, and then to the drinking aperture, and by way of the liquid receiving chamber, and wherein the adjustable liquid volume control member further has at least one movement limiting member which is mounted in the liquid receiving chamber as defined by the top surface thereof, and wherein the movement limiting member restricts the movement of the moveable diaphragm when a suction is applied to the drinking aperture so as to prohibit the moveable diaphragm from occluding the fluid flowing aperture which is formed in the liquid volume control member.

13. A liquid metering assembly as claimed in claim 12, and wherein the drinking cap has a main body having an outside facing surface, and an opposite inside facing surface, and wherein the outside facing surface defines, at least in part, a drinking spout which has a distal end, and wherein the drinking aperture is formed in the distal end, and extends therethrough; and wherein the inside facing surface of the drinking cap defines a first cavity which receives, and cooperates, at least in part with, a portion of the neck of the beverage container, and a reduced dimensioned, second cavity, which is defined by a downwardly depending sidewall, and wherein the drinking aperture, and the vent aperture communicate with the second cavity, and wherein the drinking spout defines, at least in part, the fluid passageway which extends from the second cavity to the drinking aperture.

14. A liquid metering assembly as claimed in claim 13, and wherein the moveable diaphragm has a main body defined by an outside facing surface, and an opposite inside facing surface, and wherein a second fluid passageway extends upwardly from the outside facing surface of the moveable diaphragm, and is telescopingly received, at least in part, within the fluid passageway which is defined, at least in part, by the drinking spout, and wherein the main body of the moveable diaphragm further has a sidewall which depends downwardly from the top surface, and which defines an internal cavity, and wherein the elongated valve member extends normally, downwardly, from the inside facing surface of the moveable diaphragm, and which further has a distal end, and an intermediate portion, and wherein a valve portion is made integral with the elongated valve member, and is located on the intermediate portion, and wherein a slit valve mounted on, and located in spaced relation relative to, the sidewall of the main body.

15. A liquid metering assembly as claimed in claim 14, and wherein each of the multiplicity of fluid flowing channels extends substantially radially, outwardly, from the liquid receiving chamber toward the peripheral edge, and wherein the main body can be selectively rotated so as to allow the delivery of an adjustable amount of the source of the liquid from the beverage container to the drinking spout, and wherein a finger grip extends downwardly from the bottom surface of the main body, and facilitates the selective positioning of the liquid volume control member, and wherein the top surface of the main body of the liquid control member is received, at least in part, within the internal cavity as defined by the moveable diaphragm, and the elongated valve member is received within and moveable relative to the fluid flowing aperture.

16. A liquid metering assembly as claimed in claim 15, and wherein the second cavity as defined by the inside facing surface of the drinking cap has a predetermined cross sectional dimension, and wherein the outside facing surface of the moveable diaphragm has a cross sectional dimension which is slightly less than the cross sectional dimension of the second cavity.

17. A liquid metering assembly as claimed in claim 16, and wherein the top surface of the liquid volume control member is sealably received within the internal cavity of the moveable diaphragm, and wherein the distal end of the elongated valve member depends downwardly relative to the bottom surface of the liquid volume control member.

18. A liquid metering assembly as claimed in claim 17, and wherein the suction supplied to the drinking aperture is effective in opening the slit valve relative to the vent aperture, and wherein the slit valve, upon the application of a suction, moves from a first, occluding position relative to the vent aperture, and wherein, in the first occluding position, the source of the liquid contained in the beverage container is prevented from escaping from the beverage container by way of the vent aperture; to a second non-occluding position, and wherein, in the second non-occluding position, the vent aperture is at least partially non-occluded, and a surrounding ambient environment may communicate with the internal cavity of the beverage container.

19. A liquid metering assembly as claimed in claim 18, and wherein the fluid flowing channels have a width dimension of about 1.8 mm; a length dimension of about 15 mm; and a depth dimension of about 0.2 mm to about 4 mm.

20. A liquid metering assembly comprising:

a container enclosing a source of a liquid to be dispensed;

a container cap for engaging and enclosing the source of fluid within the container, and wherein the container cap defines a dispensing aperture, and a vent aperture, and wherein a portion of the container cap defines a drinking spout;

a moveable diaphragm releasably cooperating with the container cap, and coupled in fluid flowing relation relative to the dispensing aperture, and wherein the moveable diaphragm further has a valve member; and a rotatably moveable liquid volume control member which sealably, and matingly cooperates with the moveable diaphragm, and which further defines a liquid receiving chamber and a fluid flowing aperture, and wherein the valve member of the moveable diaphragm is received in the fluid flowing aperture, and is moveable relative thereto when a suction is applied to the dispensing aperture of the container cap, and wherein the moveable liquid volume control member has a main body defined by a peripheral edge, a top surface and a bottom surface, and wherein the top surface defines the liquid receiving chamber, and wherein the fluid flowing aperture extends therethrough the main body, and wherein a multiplicity of fluid flowing channels are formed in the top surface, and each of the fluid flowing channels has a dimension distinct from the other fluid flowing channels based upon a variable thickness of the moveable liquid volume control member, and wherein at least one of the fluid flowing channels is positioned in fluid flowing relation relative to the fluid passageway, and wherein the main body is configured to be selectively, and sealably rotated relative to the moveable diaphragm so as to allow for a dispensing of a volume of the source of the liquid from the container to the drinking spout, and wherein a selective rotatable movement of the liquid volume control member relative to the moveable diaphragm varies a volume of the liquid which is dispensed from the container when a given amount of the suction is applied to the dispensing aperture relative to other positions of the liquid volume control member.

* * * * *